US008132277B2

(12) United States Patent
Buchanan

(10) Patent No.: US 8,132,277 B2
(45) Date of Patent: Mar. 13, 2012

(54) EMERGENCY RESPONSE TREATMENT BED SYSTEM

(75) Inventor: John Buchanan, Lakewood, WA (US)

(73) Assignee: United Industry, LLC, Poulsbo, WA (US)

( * ) Notice: Subject to any disclaimer, the term of this patent is extended or adjusted under 35 U.S.C. 154(b) by 146 days.

(21) Appl. No.: 12/426,199

(22) Filed: Apr. 17, 2009

(65) Prior Publication Data

US 2009/0260159 A1 Oct. 22, 2009

Related U.S. Application Data

(60) Provisional application No. 61/124,661, filed on Apr. 17, 2008, provisional application No. 61/057,140, filed on May 29, 2008.

(51) Int. Cl.
*A47B 1/00* (2006.01)

(52) U.S. Cl. ..... 5/627; 5/606; 5/626; 5/507.1; 5/617; 5/620; 5/425; 108/157.13; 211/119.006; 296/20

(58) Field of Classification Search ..... 5/8, 9.1, 5/11, 606, 625, 626, 627, 110, 111, 425, 5/662, 200.1, 201, 2.1, 617, 620, 507.1; 108/3, 108/16, 24, 91, 177, 127, 147.11–147.17, 108/157.13, 158.11, 27, 53.1, 53.3, 53.5, 108/56.1, 157.1, 157.15, 157.18, 158.13, 108/159.11; 297/283.1–283.3, 440.14, 452.14, 297/452.18, 452.2; 296/20; 211/28, 119.006, 211/119.007, 126.6, 150; 248/235, 240
See application file for complete search history.

(56) References Cited

U.S. PATENT DOCUMENTS

| | | | | | |
|---|---|---|---|---|---|
| 399,254 | A | * | 3/1889 | Foster | 5/110 |
| 869,911 | A | * | 11/1907 | Kintz | 5/617 |
| 1,788,102 | A | | 1/1931 | Gilbert | |
| 1,842,873 | A | | 1/1932 | Leeking | |
| 1,951,888 | A | | 3/1934 | Tinsley | |
| 2,877,075 | A | | 3/1959 | Kline, Sr. | |
| 3,000,018 | A | * | 9/1961 | Collins | 5/625 |
| 3,055,380 | A | | 9/1962 | Benka et al. | |
| 3,093,836 | A | | 6/1963 | Christensen et al. | |
| 3,538,521 | A | | 11/1970 | Basner | |
| 3,800,338 | A | | 4/1974 | Smith | |
| 3,930,273 | A | | 1/1976 | Stern | |
| 4,017,919 | A | | 4/1977 | Hemmeter | |
| 4,819,925 | A | * | 4/1989 | Linnemann et al. | 5/606 |
| 4,892,355 | A | * | 1/1990 | Fend | 297/440.22 |
| 4,960,277 | A | | 10/1990 | LaRossa et al. | |

(Continued)

*Primary Examiner* — Robert G Santos
*Assistant Examiner* — Nicholas Polito
(74) *Attorney, Agent, or Firm* — R. Reams Goodloe, Jr.

(57) ABSTRACT

An emergency response treatment bed system. The emergency response beds may include a frame having a pair of opposing tubular stainless steel side supports and a pair of opposing tubular stainless steel end supports. The side supports and end supports are affixed each to the other by corner fixtures. A plurality of collapsible support legs are affixed to the frame. The support legs have an upper end and a lower end, and are adapted to support the frame above a selected substrate. A support deck is coupled to the frame. The support deck is adapted to support a patient body, and is provided with a liquid impervious, molded thermoplastic contaminant resistant cleanable surface. The support deck also has, above at least some of the support legs, a cutout portion defined by edgewalls, to provide access through the support deck to the support legs, so that multiple beds may be stacked one above the other, using support inserts between vertically adjacent support legs.

37 Claims, 13 Drawing Sheets

U.S. PATENT DOCUMENTS

| | | | | |
|---|---|---|---|---|
| 5,062,171 | A | 11/1991 | Vrzalik | |
| 5,738,019 | A * | 4/1998 | Parker | 108/108 |
| 6,125,485 | A * | 10/2000 | Way et al. | 5/600 |
| 6,199,508 | B1 | 3/2001 | Miale et al. | |
| 6,230,662 | B1 | 5/2001 | Miale et al. | |
| 6,253,396 | B1 | 7/2001 | Weston | |
| 6,389,623 | B1 * | 5/2002 | Flynn et al. | 5/611 |
| 7,003,824 | B2 | 2/2006 | Roussy | |
| 7,007,329 | B2 | 3/2006 | Metzger | |
| 7,124,457 | B2 | 10/2006 | Metzger | |
| 7,448,099 | B2 * | 11/2008 | Abernathie | 5/507.1 |
| 2004/0111799 | A1 | 6/2004 | Bock | |
| 2005/0166325 | A1 | 8/2005 | Tidwell | |
| 2006/0213008 | A1 | 9/2006 | Polevoy et al. | |
| 2007/0056106 | A1 | 3/2007 | Roberts | |

* cited by examiner

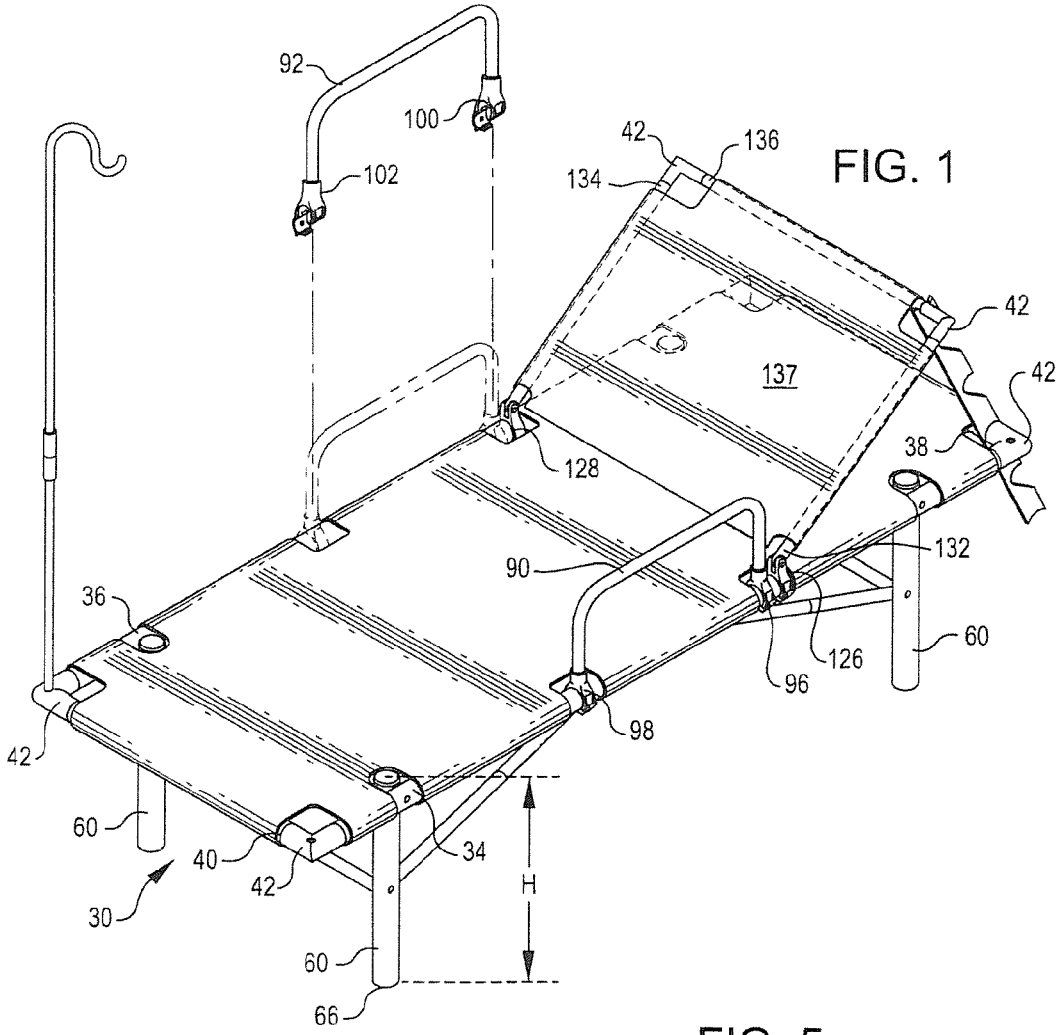
FIG. 1
FIG. 5
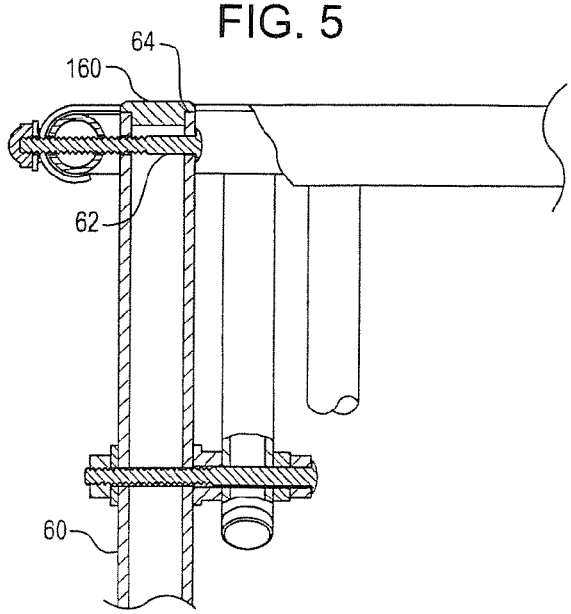

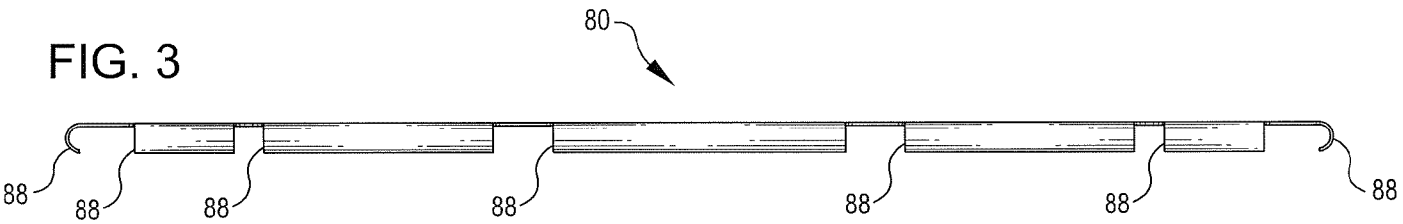
FIG. 3
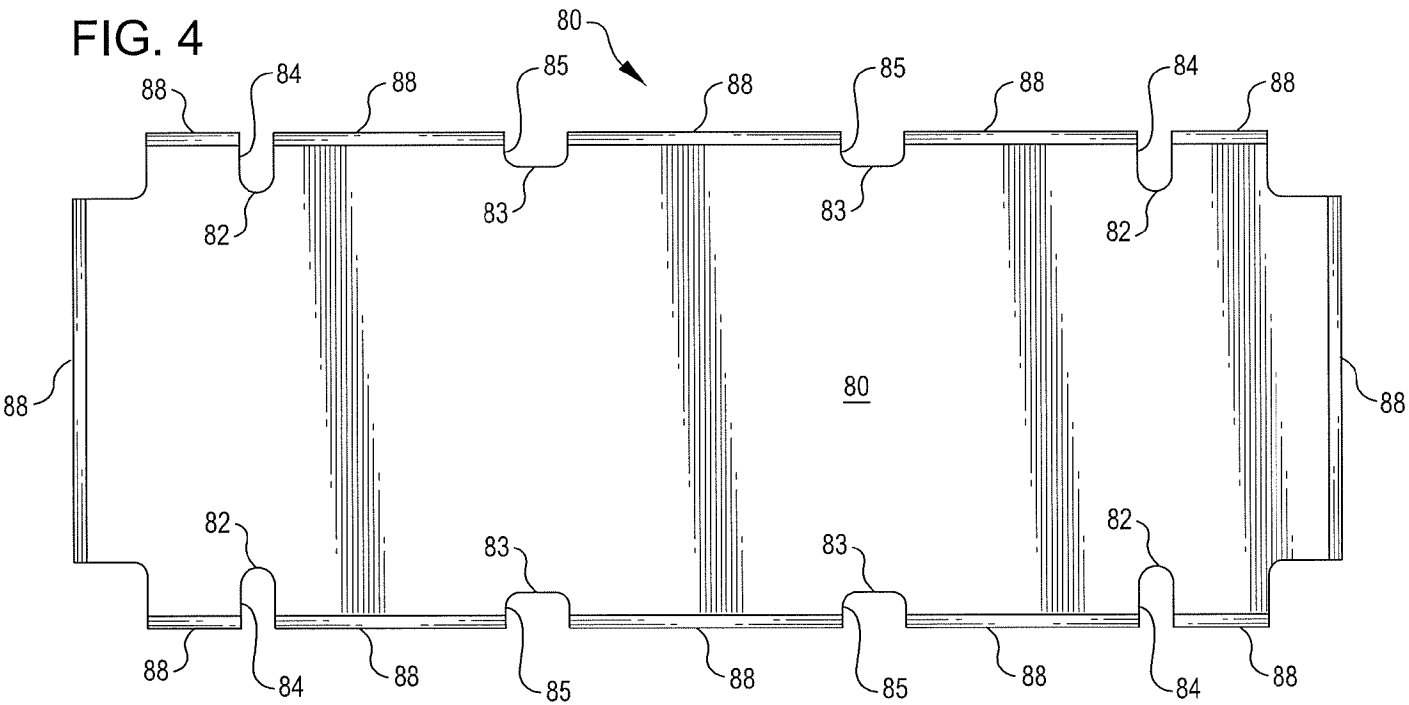
80
88
88
88
84
82
88
85
83
88
85
83
88
84
82
88
88
88
88
88
88
88

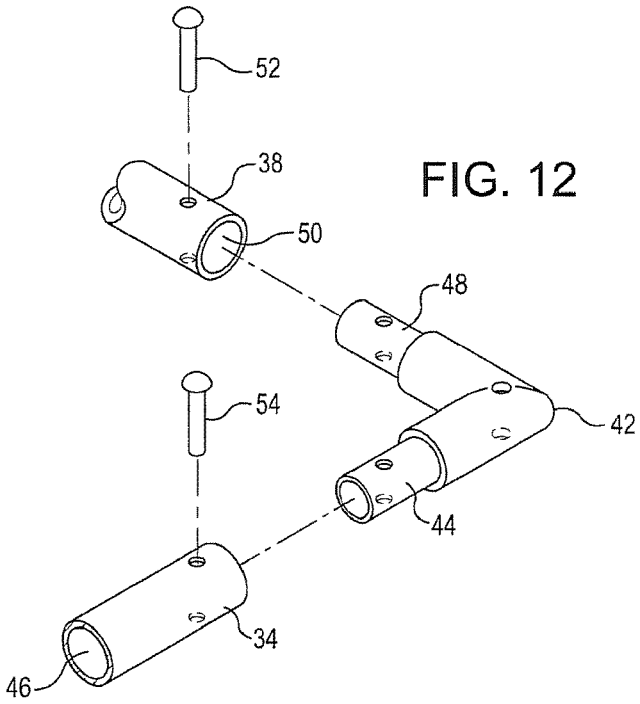
FIG. 12
FIG. 13
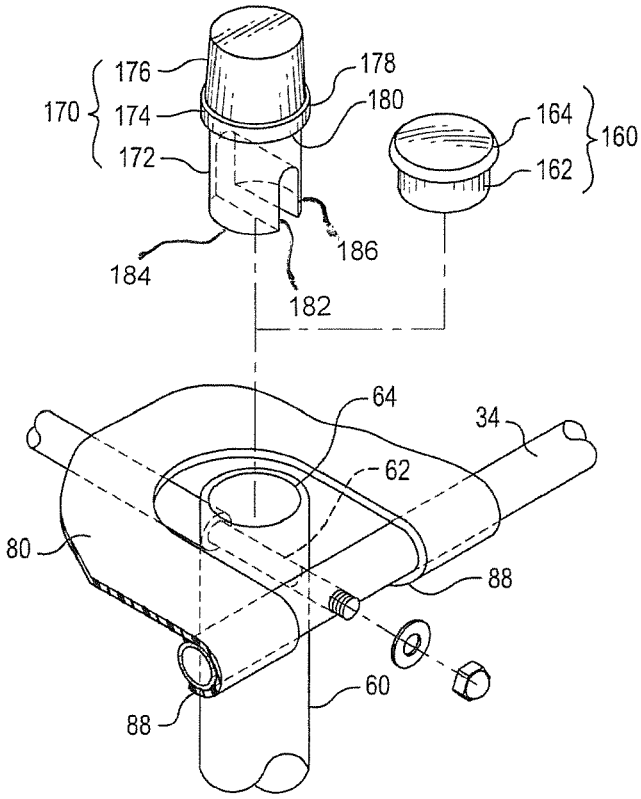

EMERGENCY RESPONSE TREATMENT BED SYSTEM

RELATED PATENT APPLICATIONS

This invention claims priority from U.S. Provisional Patent Application Ser. No. 61/124,661, filed Apr. 17, 2008, entitled EMERGENCY RESPONSE TREATMENT BED SYSTEM, and U.S. Provisional Patent Application Ser. No. 61/057,140, filed May 29, 2008, entitled EMERGENCY RESPONSE TREATMENT BED SYSTEM, the disclosures of each of which are incorporated herein in their entirety, including the specification, drawing, and claims, by this reference.

COPYRIGHT NOTICE

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This invention relates to beds, and more particularly, to patent care beds for use by emergency response teams, particularly for such teams engaged in responding to mass casualty or disaster incidents.

BACKGROUND

In the art of hospital beds or emergency response beds, many different versions are widely available. However, available versions known to me have not been configured in an adaptable or interchangeable manner that allows use of the beds in a multitude of different configurations, depending upon the situation actually encountered. Nor have such prior art beds been offered in designs with flexibility to meet the needs of patients, and medical staff in such a facility. Nor have such prior art beds or bed systems been provided with adaptable features for handling deceased patients.

Further, in many governmental jurisdictions, new legislation or regulations have been adopted or are proposed that recommend or require the acquisition, availability, or use of certain types and numbers of beds in case of a significant incident, such as a major natural catastrophe, industrial accident, or terrorist incident.

Various systems have adopted certain technological features. However, in such prior art devices known to me, there are significant drawbacks with respect to the ability to decontaminate the beds after use, so that they can be reused during an ongoing incident. Further, in such prior art beds, multiple designs or alternate structures must generally be acquired to allow multi-functional roles of the equipment. Thus, there remains a significant and as yet unmet need for an emergency response treatment bed system configuration that would allow easy and quick interchangeability, such as between hospital bed configuration, patient cot configuration, cadaver storage configuration, autopsy configuration, or office desk configuration, without the necessity of acquiring or utilizing completely separate hardware components for such tasks.

SUMMARY

I have now developed an emergency response treatment bed system and bed configuration that allows multi-functional configurations to be provided from a single base design configuration for beds. The emergency response treatment bed configuration is provided with a generally horizontally oriented tubular outer support frame, to which are affixed a plurality of vertically extending support legs. In an embodiment, the vertically extending support legs are adjustably affixible at a selected height. Thus, the height of a generally planar bed surface is adjustable above a substrate such as an emergency room floor.

An adjustable, multi-position clamp may be mounted in or one or more of the adjustable leg portions of the vertically extending support legs. In an embodiment, the clamp may be configured as a generally inverted V-shaped clamp having transversely mounted locatable snap buttons that are manually operable for adjustment to a selected hole location along the vertically extending support legs, so that the leg is locked at a selected height. In an embodiment, a roller/caster can be removably mounted to the vertically extending support legs, so that the bed or other resultant structure may be rolled across a substrate such as an emergency room floor. In an embodiment, three or more different heights may be selected, with a plurality of matching holes provided in the vertically extending support legs.

In an embodiment, the emergency response treatment bed system is provided with an impervious, cleanable support that can be easily decontaminated. When used as a hospital bed, the bed may be provided with a mattress and bedding. Further, when used as a hospital bed, side bed rails may be provided. Such bed rails may be provided in a secure yet detachable configuration, where such rails are snapped into place via rail clamps. A clamp may be provided that is adjustably positionable to any one of a plurality of stable positions on said generally horizontal frame.

The emergency response treatment bed system can be configured as a body rack, having the ability to support two or three bodies in a vertically stacked configuration. Connecting plugs are inserted in the top of vertical legs of a first bed, so that the vertical legs of a second bed are supported via the vertical legs of a first bed. Further connecting plugs can be inserted in the top of vertical legs of a second bed, so that the vertical legs of a third bed are supported via the vertical legs of a second bed.

The emergency response treatment bed system can be configured as a work station, having a horizontal work surface. Further, connecting plugs can be inserted in the vertical support legs along one side of the bed, so support a bookshelf structure. The book shelf structure can be provided with adjustable shelves that are storable in a flat configuration, but when installed, are can be lowered and secured into a horizontal configuration as multiple book shelves. Also, in such a configuration, the horizontal work station surface is adjustable to a selected vertical height by adjustment of the height of vertical support legs, or alternately, by adjustment of the height of the roller/caster slug leg height.

The emergency response treatment bed system can be configured as an autopsy table, by providing an autopsy tray service mounted to the top of the vertical support legs.

The foregoing briefly describes an exemplary emergency response treatment bed system and various elements or components thereof. The various objectives, features and advantages of the invention(s) will be more readily understood upon consideration of a detailed description, taken in conjunction with careful examination of the accompanying figures of the drawing, as by the appended claims.

BRIEF DESCRIPTION OF DRAWING

In order to enable the reader to attain a more complete appreciation of the invention, and of the novel features and advantages thereof, attention is directed to the following detailed description when considered in connection with the accompanying drawings, wherein:

FIG. 1 provides a perspective view of an embodiment for an emergency response bed, with a patient support deck provided and replaceably mounted on a tubular stainless steel frame, and further including bed side rails and a backrest with backrest supports, as well as a standard for use in administering intravenous medications.

FIG. 3 is a side view of an embodiment for a support deck for an emergency response treatment bed, showing the generally C-shaped clamping peripheral portions at the ends of the bed that clamp to end support members of the frame.

FIG. 4 is plan view of the support deck just illustrated in FIG. 3, now showing how a plurality of generally C-shaped clamping peripheral portions are provided around the perimeter of a generally horizontal support deck.

FIG. 5 provides a partial vertical cross-sectional view of a support leg, showing a first pivot pin mounted between a support leg and the frame, and a second pivot pin mounted between the support leg and an extensible and collapsible angular cross-member.

FIG. 12 provides an embodiment for a corner fixtures used to join side supports and end supports of the frame; in this embodiment, the side supports and end supports are provided in tubular steel, and the corner fixtures include an insert having an outer cylindrical surface sized and shaped for snug mating engagement with each of the adjacent end support and side support members.

FIG. 13 shows alternate use of a top support cap or support inserts (also may be called mounting plugs) for placement into the top end of a support leg; the top support cap is used when no additional beds are stacked above (or when no shelf is utilized), and the support inserts are used when the lower end of a support leg of a second bed, or the lower end of a vertical member of a shelf unit, is supported.

Figure 2:
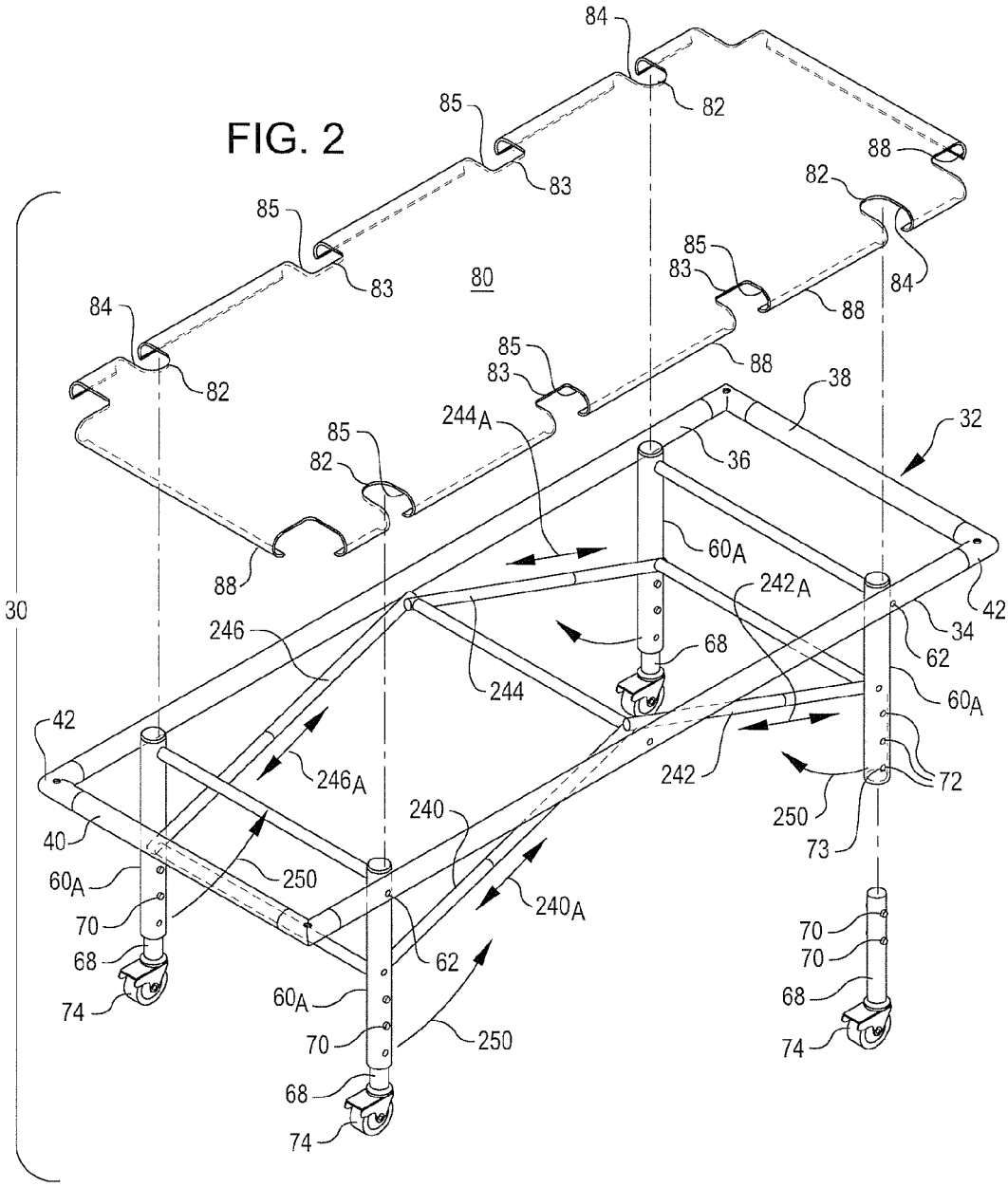
FIG. 2 provides an exploded perspective of an emergency response bed, showing how, in an embodiment, a flexible, resilient support deck is replaceable, using a snap fit configuration wherein the generally C-shaped peripheral portions of the support deck snap over stainless steel frame members. Also visible are collapsible support legs, and vertically adjustable support leg portions with rolling castor wheels.
Figure 6:
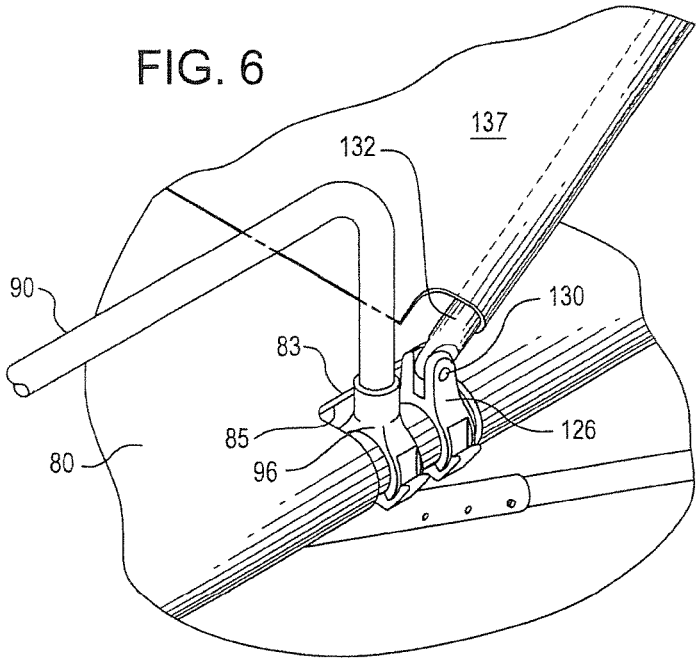
FIG. 6 provides a perspective view of a portion of an emergency response bed adjacent a cutout portion in the support deck, wherein a first locking clamp secures a side rail to side support member of the frame, and wherein a second locking clamp pivotally secures a backrest to the side support member of the frame.

In the various figures of the drawing, like features may be illustrated with the same reference numerals, without further mention thereof. Further, the foregoing figures are merely exemplary, and may contain various elements that might be present or omitted from actual implementations of various embodiments depending upon the circumstances. An attempt has been made to draw the figures in a way that illustrates at least those elements that are significant for an understanding of the various embodiments and aspects of the invention.

However, various other elements of an emergency response treatment bed system, especially as applied for different variations of the functional components illustrated, as well as different embodiments of artistic elements such as a shape of components or visual design of various elements, may be utilized in order to provide a useful, reliable, and easily decontaminated emergency response treatment bed system.

DETAILED DESCRIPTION

Attention is directed to FIG. 1 of the drawing, wherein an exemplary emergency response treatment bed 30 is shown. In an embodiment, the bed 30 is provided with a frame 32 including a pair of opposing tubular stainless steel side supports 34 and 36, and a pair of opposing tubular stainless steel end supports 38 and 40. The side supports 34 or 36, and the end supports 38 or 40, are affixed each to the other by corner fixtures 42. As better seen in FIG. 12, in an embodiment the end support 38 and side support 34 are tubular members, and the corner fixtures 42 include a first cylindrical surface insert portion 44 that engages in tight fitting relationship an inner surface 46 of side support 34, and a second cylindrical surface insert portion 48 that engages in tight fitting relationship an inner surface 50 of end support 38, for example, as better seen in FIG. 12. Locking pins (52 and 54) or other suitable fasteners may be used to secure the corner fixtures 42 to their respective side supports 34 or 36 or to their respective end supports 38 and 40.

Figure 14:
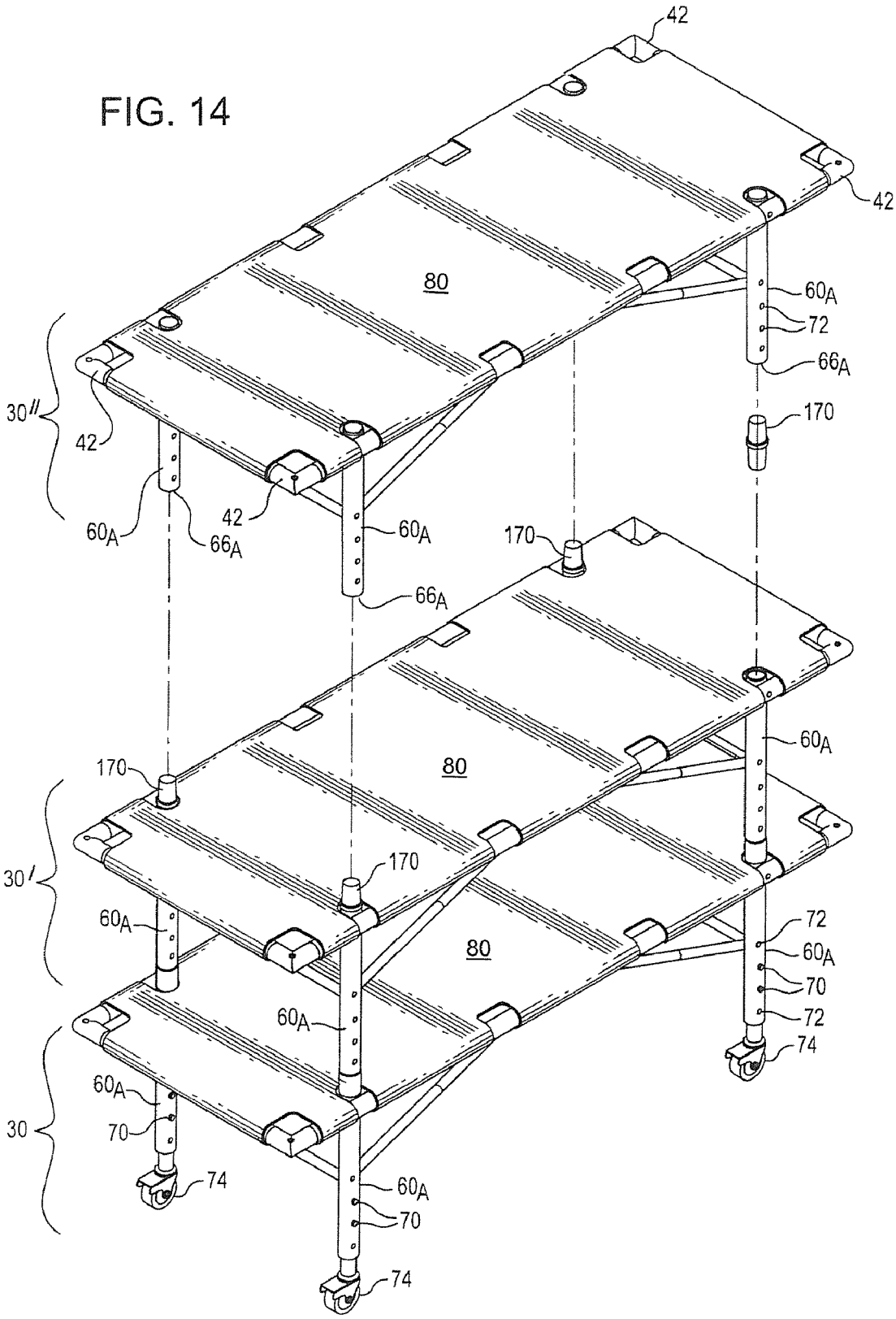
FIG. 14 shows how multiple emergency response beds may be securely stacked one above the other; here, first, second, and third beds are provided, and the use of support inserts to locate and secure support legs one above the other is shown.

Returning now to FIG. 1, a plurality of support legs 60 are affixed to the frame. As seen in FIG. 5, in an embodiment, the support legs 60 are pivotally affixed to the frame at a first pivot 62. The support legs have a top end 64 and a bottom end 66 and a height H therebetween. In an embodiment, as better seen in FIG. 2, adjustable support legs $\mathbf{60}_A$ having a lower end $\mathbf{66}_A$ may be provided, which further include a vertically adjustable leg portion 68, with spring loaded stop buttons 70 that interact with apertures 72 defined by edgewall portions 73 in adjustable support legs $\mathbf{60}_A$. Also, as seen in FIG. 2, rollers or roller/caster wheels 74 may be affixed to enable bed 30 (or stacked bed as seen in FIG. 14) to easily roll.

The support legs 60 or 60A, as the case may be, are adapted to support frame 32 a selected height above a selected substrate, or more particularly, to support a patient support deck 80 at a selected height above a substrate. The support deck 80 is coupled to the frame 32. In an embodiment the support deck 80 is of sufficient strength and is adapted to support a patient body, plus applicable design margin for safety (for example up to about 500 pounds weight total). In an embodiment, the support deck 80 may be provided in a thermoplastic molded material. In an embodiment, as suitable cleanable material that is impervious to liquids, such as nylon 6/6 may be utilized to provide support deck 80. In an embodiment, the support deck 80 is provided, above at least some of the support legs 60 or $\mathbf{60}_A$, a cutout portion 82 defined by edgewalls 84. In an embodiment, the support deck 80 may be provided with additional cutouts 83 defined by edgewalls 85, for use along a side support 34 or 36 to affix other components such as side rails and backrests, as further discussed below. The cutout portion 82 provides access through the support deck 80 to at least some of the support legs 60 or $\mathbf{60}_A$.

As can be appreciated from comparison of FIGS. 2, 3, and 4, in an embodiment, an existing support deck 80 may be removable from frame 32, and replaceable with a new support deck 80. That might be advantageous after damage to a support deck 80, or after sever severe contamination or stain, such as resulting from treatment chemicals or contamination brought to the bed by a patient. In an embodiment, the support deck 80 may include a plurality of peripheral clamping members 88. The peripheral clamping members 88 are configured for securely affixing the support deck 80 to said side supports 36 and 36, and/or to the end supports, 38 and 40, as applicable in a particular embodiment. In an embodiment, the peripheral clamping member 88 are provided as resilient, flexible portions of the support deck 80, and may be integrally formed with and molded as a unitary component. As seen in FIG. 3, in an embodiment, the peripheral clamping members 88 of support deck 80 may be provided having a generally C-shaped structure, in vertical cross-section.

As noted above, along at least some portion of the side supports 34 and 36, a second cutout portion 83 defined by second edgewalls 85 are provided, to allow access through the support deck 80 to said side supports 34 and 36. This configuration allows at least one side rail member 90 or 92 to be detachably affixed to one of the side supports 34 or 36, respectively. In an embodiment two side rail members, namely downwardly oriented U-shaped side rails members 90 and 92, may be detachably affixed to side supports 34 and 36, respectively.

Figure 7:
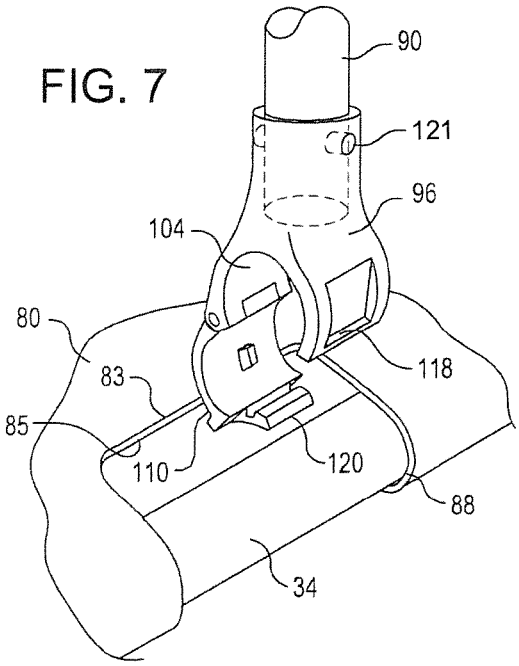
FIG. 7 is a perspective view of an locking clamp member, showing a body including a generally C-shaped over centered portion sized and shaped for snap fitting engagement with a side support member of the frame provided in a tubular configuration, and a locking portion pivotally affixed to a first distal end of the body, with a locking tab configured for locking engagement with a locking notch provided on a second distal end of the body.
Figure 8:
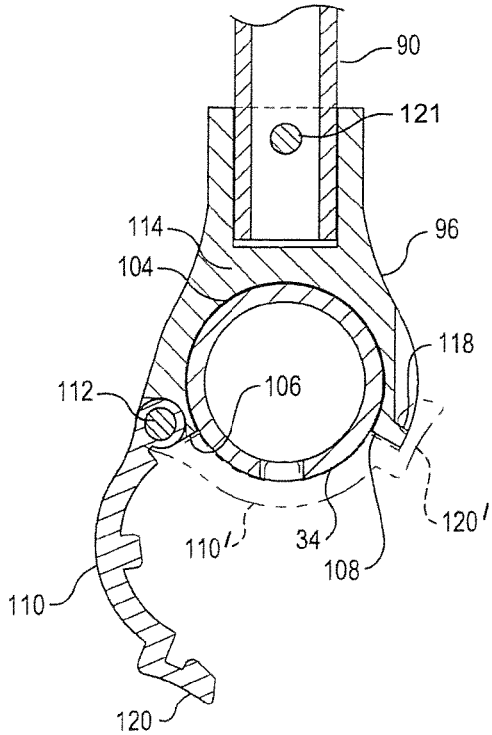
FIG. 8 is a cross-sectional view of the locking clamp member just shown in FIG. 7, now more clearly showing the side rail receiving end of the body and locking pin to secure the side rail in the body, as well as the snug fitting engagement of the body when snapped on to the side support member of the frame, as well as the locking portion pivotally affixed to a first distal end of the body, and the locking tab on the locking portion that is configured for locking engagement with a locking notch provided on a second distal end of the body, where the side rail receiving body is snapped in place on the tubular side support portion of the frame, but with the final clamp locking mechanism yet to be snapped in place to affix and to secure the clamp in place.

As seen in FIG. 1, in an embodiment, side rail members 90 and 92 are affixed to side supports 34 and 36, respectively, by way of a pair of clamps. As seen in FIG. 1, claims 96 and 98 are used to affix side rail 90 to side support 34, and clamps 100 and 102 are used to affix side rail 92 to side support 36. As seen in FIGS. 7 and 8, claim 96 (and similar clamps 98, 100, and 102) may be provided as an interference fit, over centered downwardly opening C-shaped member adapted to snap fit to the adjacent side supports, such as side support 34 seen in FIG. 8. In other words, the downwardly opening C-shaped clamp 96 includes a tubular accepting portion 104 generally adapted to fit over a portion of a cylinder, and snap into place, as first 106 and second 108 distal ends are fitted at more than the outer radius of the tubular member (34 or 36) about which they clamp. As seen in FIG. 8, the claim clamp 96 further includes a locking clamp portion 110. The locking clamp portion 110 provides a gap closing function adapted to close the gap in the C-shaped clamps, to provide a generally cylindrical clamping surface for compression fit to the side support 34. The locking clamp portion 110 is pivotally affixed at pivot 112 to the first distal end 106 of body 114 of clamp 96. A locking tab 116 is configured for locking engagement with a locking notch 118 provided adjacent the second distal end 108 of the body 114 of clamp 96. FIG. 8 more clearly shows the side rail receiving end interior tubular accepting portion 104 of the body 114. Also shown is the locking pin 121 used to secure the side rail 90 in the body 114 of clamp 96. As shown in FIG. 8, the locking clamp portion 110 is in the unlocked position, but the locked position is shown in hidden lines as 110', with snap lock 120 shown unfastened and shown secured as snap lock 120' in hidden lines. Other clamps (98, 100, 102) may be provided with similar functional structure.

Figure 9:
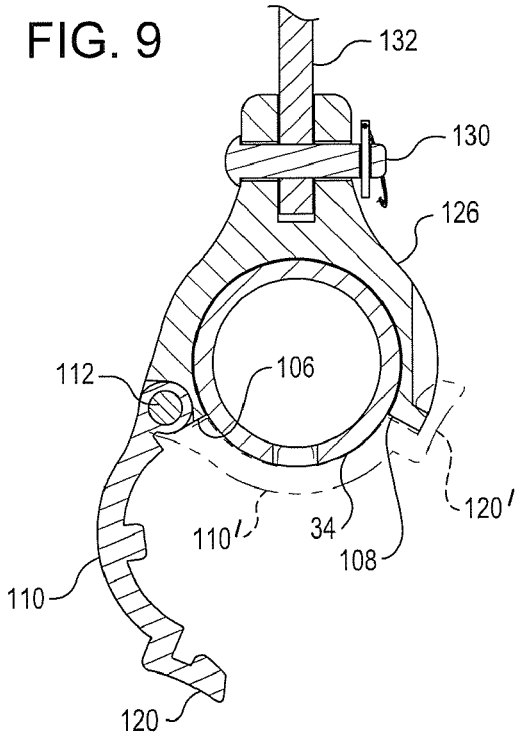
FIG. 9 provides a cross-sectional view of a backrest locking clamp configuration, showing how the backrest is pivotally affixed to the backrest locking clamp; other features are similar to that just illustrated for the side rail locking clamp member.

An upwardly supported backrest portion 122 may be provided when to a bed 30 when desired. In an embodiment, the upwardly supported backrest 122 may have a lower end 124 pivotally affixed to the side support members 34 and 36. As seen in FIGS. 1 and 9, backrest clamps 126 and 128 may be provided to pivotally affix the backrest 122 to the side supports 34 and 36. The backrest clamps 126 and 128 may be provided with substantially similar structure and function to the above described clamp 96, except that a pivot pin 130 pivotally connects backrest frame 132.

Figure 10:
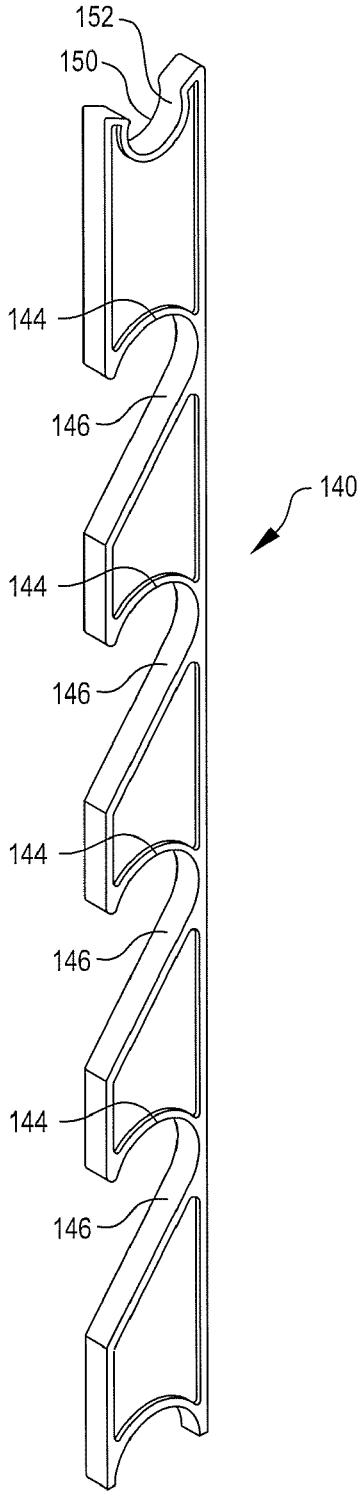
FIG. 10 illustrates one embodiment for a backrest support member, wherein generally question mark shaped walls formed by cutouts in the support member provide secure support ledges to support a backrest at a selected upward angle for the adjacent support deck.
Figure 11:
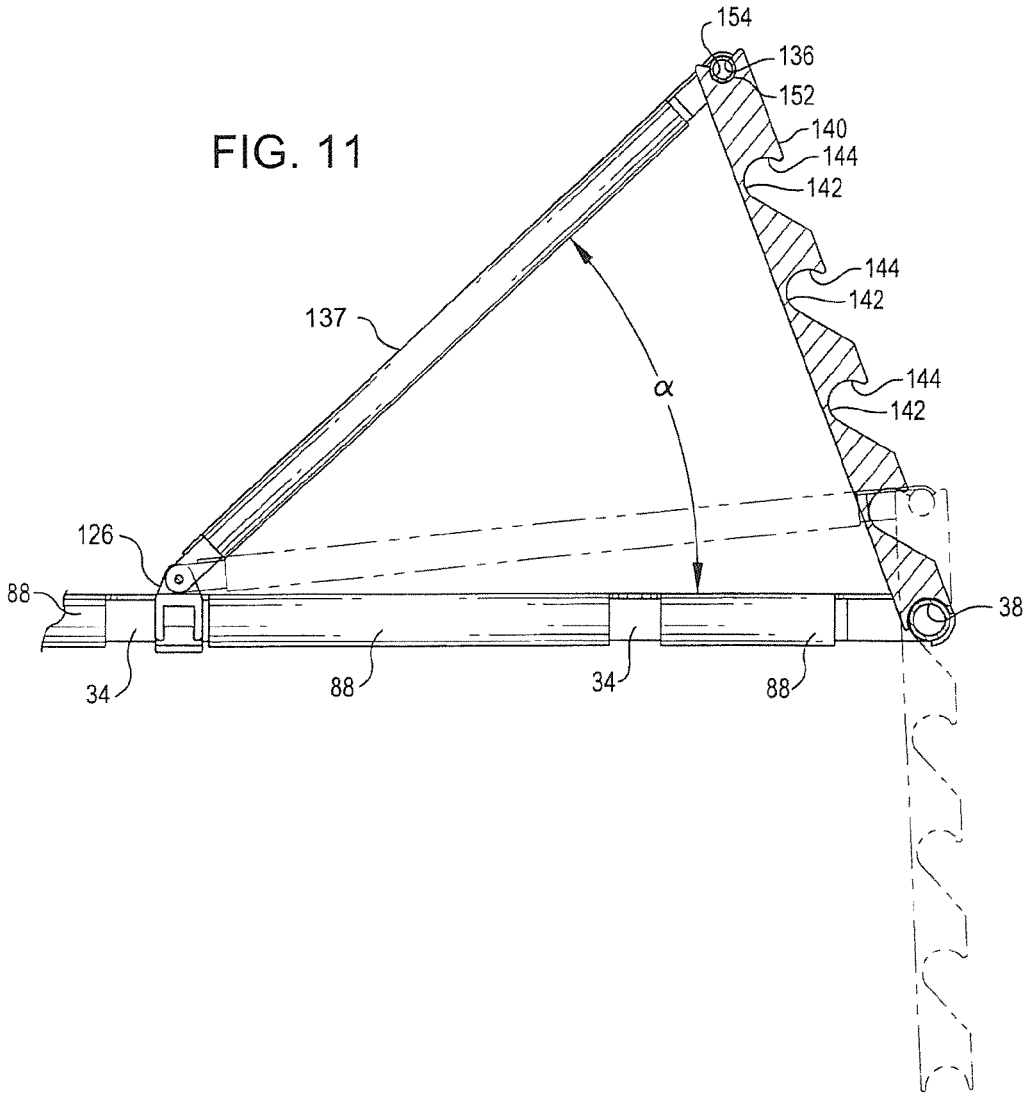
FIG. 11 illustrates the angularly adjustable feature of a backrest portion, wherein the backrest support member is secured at a first position in the upright, larger angle configuration, and wherein the backrest support member is secured at a second position in a more prone, smaller angle configuration, while the backrest is pivotally supported from a backrest locking clamp.

In an embodiment, the backrest portion 122 may have backrest sides 132 and 134, and backrest end 136, with a corner support 42 joining the same as above described. A backrest deck 137 may be provided in similar materials and with similar attachment characteristics as generally described above with respect to support deck 80, and thus, additional explanation need not be repeated to those of skill in the art and to which this specification is directed. A backrest support member or a pair of backrest support members 140, maybe provided to support the backrest portion 122 at a desired angular position. The backrest support member(s) 140 extend from end support 38 to backrest end support 136 of the backrest portion 122. In an embodiment, back rest support member(s) 140 are configured with a plurality of notches 142 to provide support ledges 144, so that the support ledges 144 provide support for the backrest 122 at selected upward angle alpha ($\alpha$) from the support deck 80. As best seen in FIG. 10, the support ledges 144 are formed by generally question mark shaped walls 146 formed by cut-outs in the elongate backrest support member 140. In an embodiment, the backrest support member 140 may include upper sidewalls 150 that form an over-centered, snap fit cutout 152 sized and shaped for complementary, snug fitting mating engagement with the outer surface 154 of a backrest end support 136.

As seen in FIGS. 5 and 13, the upper end 64 of support leg 60 may be provided with a removable top support cap 160. In an embodiment, the support cap 160 is provided with a insert portion 162 and an outer flange portion 164 to fit over the upper end 64 of support leg 60. In yet another embodiment, support inserts (also called mounting plugs) 170 may be provided. The support inserts 170 have an insert plug portion 172, an interference support portion 174, and an upper guide portion 176. In an embodiment the interference support portion 174 includes a peripheral flange portion 178 having a lower edge portion 180 sized and shaped to support the support insert 170 above the upper end 64 of the support leg 60. As seen in FIG. 13, in an embodiment, the frame 32 is coupled to the support leg 60 by a supporting pivot pin 62. In this configuration, the insert plug portion 172 includes a cutout 182 defining downwardly extending prongs 184 and 186 fitting downward on either side of the pivot pin 62.

In order to stack beds one over the other, the peripheral flange portion 178 of the interference support portion 174 includes an upper edge portion 190 that is shaped and sized to support the lower end 66 of a support leg 60. As shown in FIG. 14, multiple beds, including first bed 30, second bed 30' and third bed 30" may be stacked using the support inserts 170. In such a configuration, the components of each of the first bed 30, the second bed 30', and the third bed 30" may be considered as the components of a first, second, and third beds respectively as applicable, as will be understood by those of skill in the art, and thus such nomenclature need not be repeated for each such repetitive part. However, it should be observed that a plurality of support inserts 170 are provided, and that at least some of such support inserts 170 are provided at the upper end of said the respective first support legs 60 to support the second bed 30' Likewise, at least some of a plurality of support inserts 170 are provided at the upper end of the respective second support legs 60 of second bed 30', in order to support the third bed 30".

In embodiment as seen in FIG. 14, for example, the support legs $\mathbf{60}_A$ further include adjustable leg members 68 that are securely affixable at a selected length, so that said support deck 80 of first bed 30 is positionable at a selected height above a selected substrate. And, as mentioned above, support legs 60 or 60A may be provided with a rolling wheel 74 affixed to the lower end thereof, to enable the stack of first bed 30, second bed 30', and third bed 30" to be moved as desired.

Figure 16:
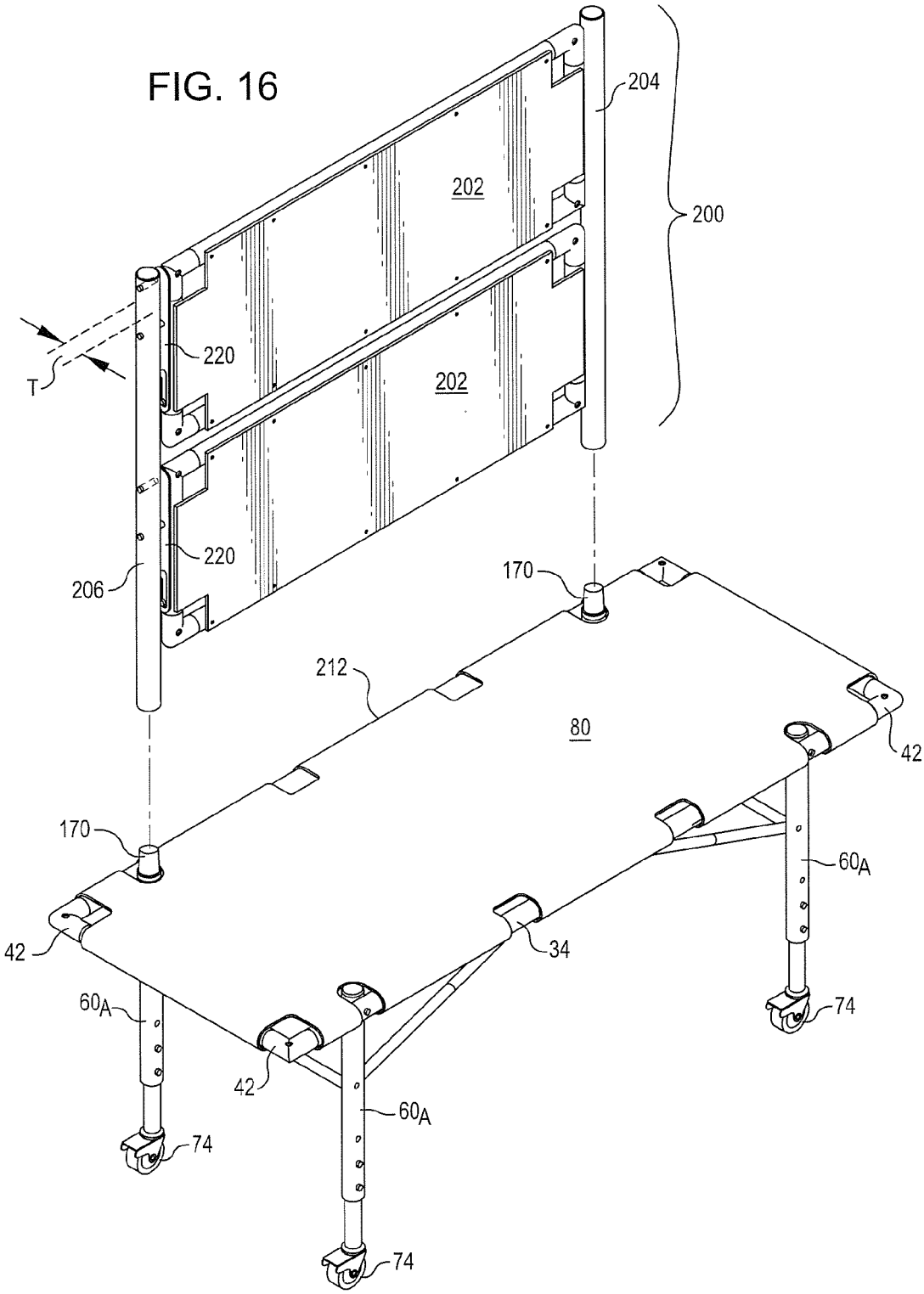
FIG. 16 shows the use of support inserts to support a shelving unit; the shelving unit is depicted in the thin stowed configuration, with shelves extending between first and second vertical legs.
Figure 17:
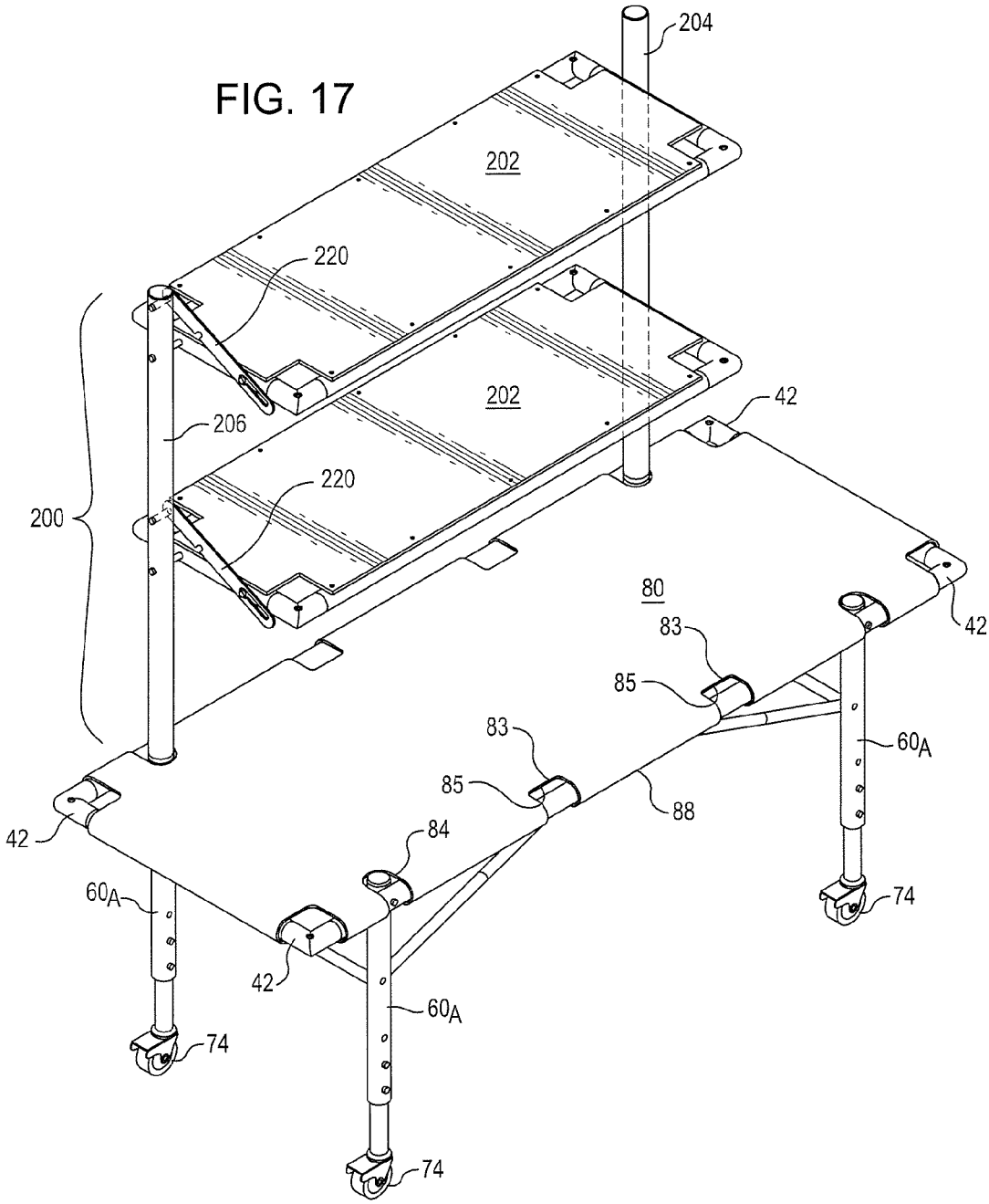
FIG. 17 shows the shelving unit just illustrated in FIG. 17 above, but now fully installed, and opened to a working position, as well as showing adjustable roller/caster support legs, showing snap buttons used for adjustment of vertical height of the support deck.
Figure 18:
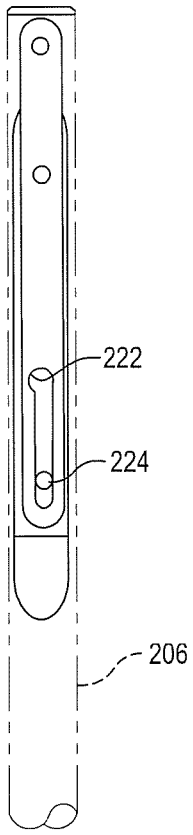
FIG. 18 illustrates one embodiment for adjustable shelf brackets, here shown with the shelving members in the stowed configuration.
Figure 19:
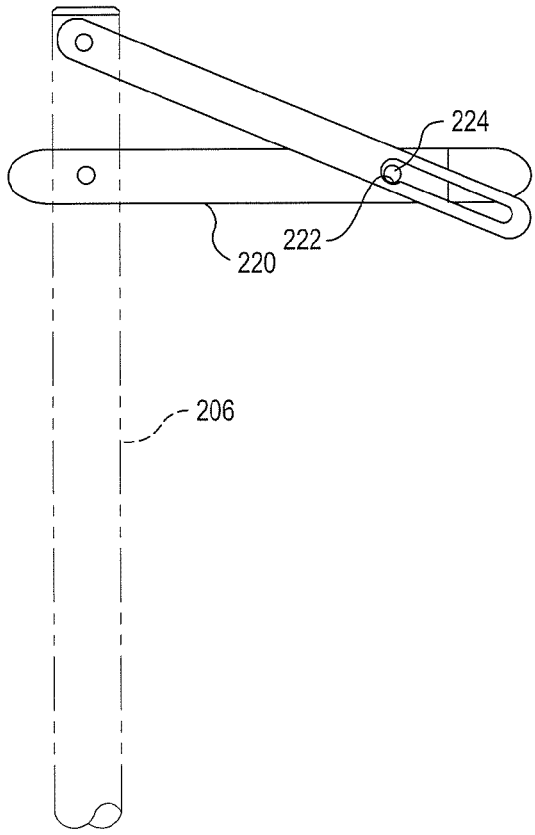
FIG. 19 illustrates the embodiment for adjustable shelf brackets, her shown in he position wherein the adjustable shelf brackets are extended to a working shelf position, with the eccentric detent sized and shaped for locking support of the shelves in a support position.

Turning now to FIGS. 16, 17, 18, and 19, in an embodiment, a support deck 80 may be turned into a desk by addition of a shelving unit 200. The shelving unit 200 includes pivoting shelves 202 spaced apart between vertical posts 204 and 206. The vertical posts 204 and 206 include lower post ends 208 and 210, respectively, which are each sized and shaped for complementary mating engagement downward into a support insert 170. In an embodiment, a pair of support inserts 170 may be located along a first side 212 of a support deck 80. As shown in FIG. 16, the shelves 202 have a stowed configuration wherein the shelves are configured as a generally flat shelving unit 200 of selected thickness T. When first affixed to bed 30, shelves 202 may be vertically oriented when in a stowed configuration. The shelves 202 are connected to vertical posts 204 and 206 via adjustable shelf brackets 220. The adjustable shelf brackets 220 are adjustable between (a) a support position wherein said shelves 202 are supported in a generally horizontal configuration for use, and (b) a stowed configuration, wherein the shelves 202 are folded into a generally flat, stowed position. In an embodiment, the adjustable shelf brackets 220 include an eccentric detent 222 sized and shaped for locking support of pin 224 to hold the shelves 202 in the working, horizontal support position. Adjustable shelf brackets are otherwise pivotally supported from vertical posts 204 and 206, as can be seen in FIGS. 17, 18, and 19.

Figure 15:
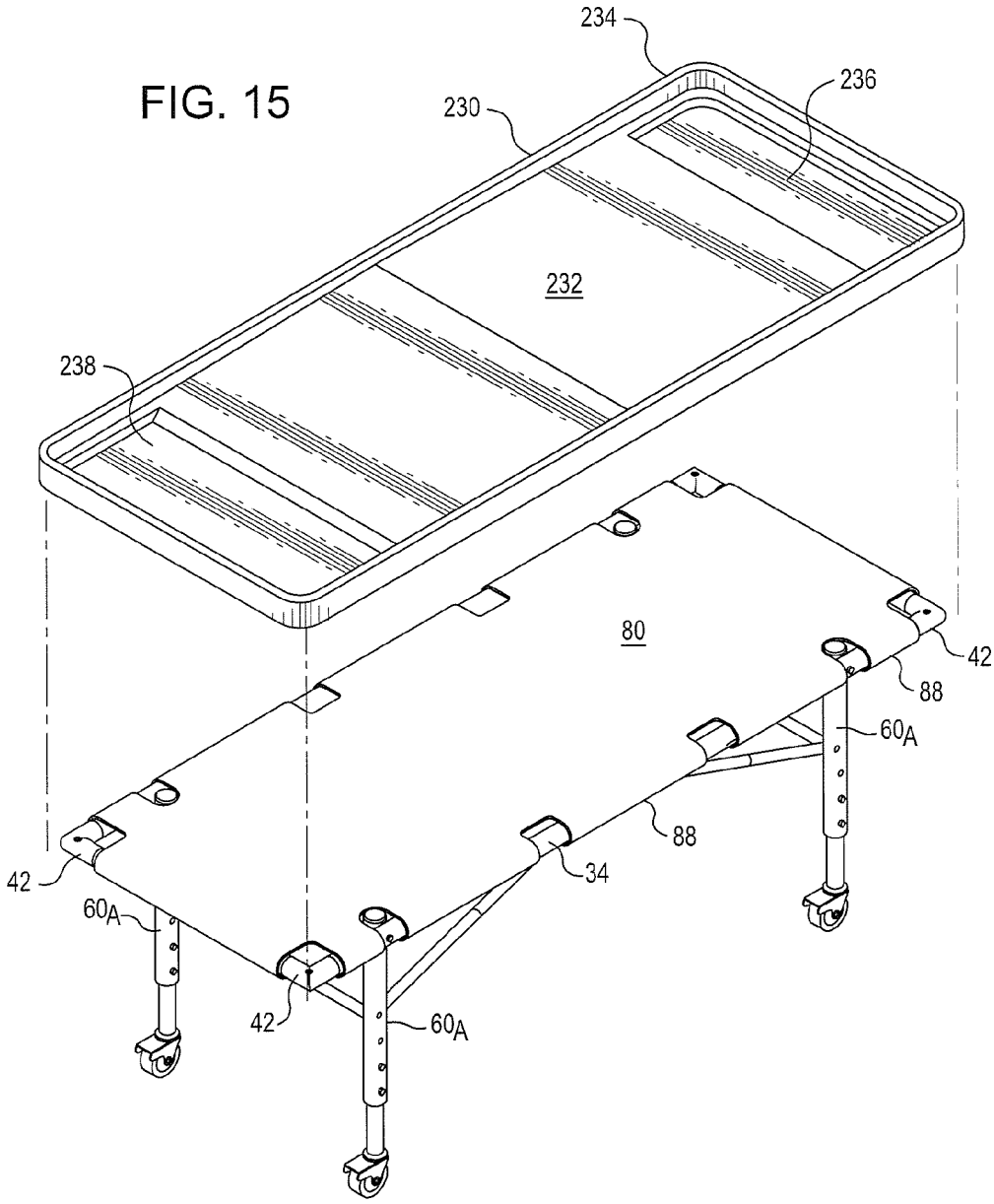
FIG. 15 provides a liquid containing autopsy tray, having a generally planar or flat surface, with raised edges, and in an embodiment, first and second basin portions adjacent the top and the bottom of the autopsy tray.

As noted in FIG. 15, in an embodiment, an autopsy tray 230 may be provided, to be supported by support deck 80, or affixed to frame 32. The autopsy tray 230 may take the form of an elongate tray that is a liquid containing vessel having a generally planar surface 232 and raised peripheral edges 234, Liquid troughs 236 and 238 may also be provided in the autopsy tray.

Attention is directed to FIG. 2, wherein the use of collapsible angular support members 240, 242, 244, and 246 is illustrated. Basically support legs 60 or 60A are supported, for strength, by angular support member 240, 242, 244, and 246; however these members are adjustably extensible as noted by reference arrows $\mathbf{240}_A$, $\mathbf{242}_A$, $\mathbf{244}_A$, and $\mathbf{246}_A$, so that length of the angular support member is extendible to a working position wherein the support legs 60 or $\mathbf{60}_A$ are in the upright and working position, or may be retracted, to where the support legs 60 or $\mathbf{60}_A$ are in the horizontal, or stowage position; the action of legs 60 or $\mathbf{60}_A$ toward the horizontal or stowage position is shown by reference arrows 250. Thus, beds 30 are easily collapsible, so that beds fold into a substantially flat, stackable form.

Figure 20:
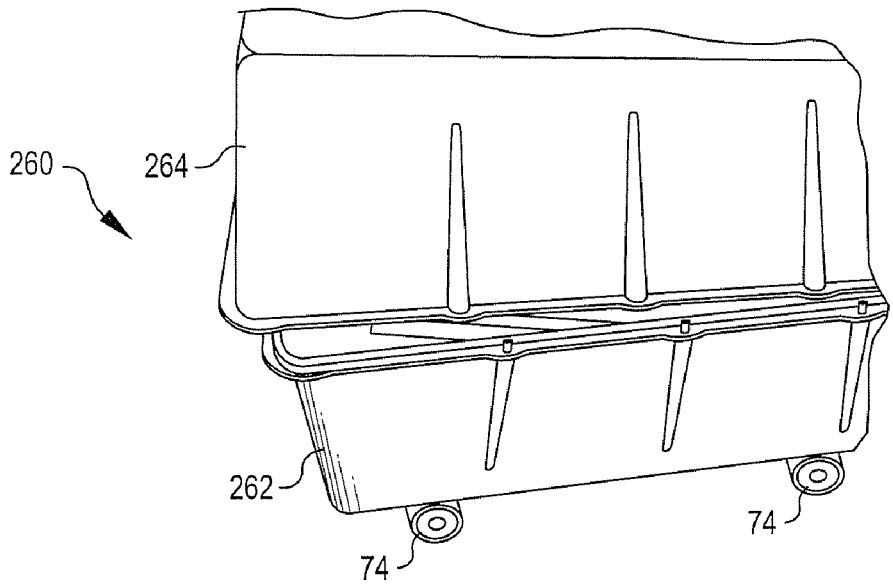
FIG. 20 shows a storage cabinet for the emergency response treatment bed system, where the storage cabinet is open for removal of emergency response treatment beds for use, and also showing the use of rollers/caster wheels for ease in moving the storage cabinet.
Figure 21:
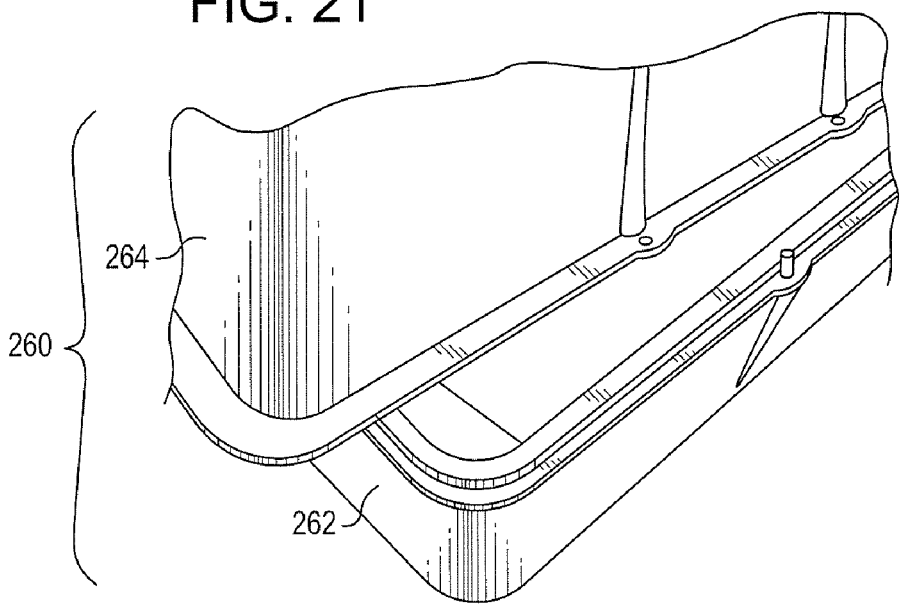
FIG. 21 illustrates a storage cabinet for the emergency response treatment bed system, here showing flanges on upper and lower portions of the storage cabinet, with a seal between the flanges to securely protect the emergency response treatment bed when the upper and lower portions of the storage cabinet are affixed each to the other at the seal, so as to prevent dirt and moisture from entering the storage cabinet during long term storage.

As shown in FIGS. 20 and 21, a container 260 may be provided, sized and shaped for holding a plurality of collapsible beds 30. The container 260 includes sealingly engageable mating lower 262 and upper 264 portions having sealing flanges 266 and 268, respectively. When sealed, the container 260 provides for secure moisture resistant storage for a package of emergency beds 30. To facilitate ease in handling, the container 260 may also be provided with rollers 74.

Other details of worthy of mention in the emergency bed system include that the stainless steel member may, in an embodiment, be provided in a surgical grade steel. In an embodiment, such stainless steel members may be provided as grade 304 stainless steel. Also, while the support deck 80 has been described as being provided in nylon, or a moldable thermoplastic material, it is to be understood that other suitable materials may provide the snap on fit and replaceable characteristics, and have the ability for decontamination, as described herein, and thus, it is not intended to limit the invention to the specific embodiments mentioned.

It is to be appreciated that the various aspects, features, structures, and embodiments of an emergency response treatment bed system as described herein is a significant improvement in the state of the art. The bed design provided is simple, reliable, and easy to use. Although only a few exemplary aspects and embodiments have been described in detail, various details are sufficiently set forth in the drawing figures and in the specification provided herein to enable one of ordinary skill in the art to make and use the invention(s), which need not be further described by additional writing.

Importantly, the aspects, features, structures, and embodiments described and claimed herein may be modified from those shown without materially departing from the novel teachings and advantages provided, and may be embodied in other specific forms without departing from the spirit or essential characteristics thereof. Therefore, the various aspects and embodiments presented herein are to be considered in all respects as illustrative and not restrictive. As such, this disclosure is intended to cover the structures described herein and not only structural equivalents thereof, but also equivalent structures. Numerous modifications and variations are possible in light of the above teachings. The scope of the invention, as described herein is thus intended to include variations from the various aspects and embodiments provided which are nevertheless described by the broad meaning and range properly afforded to the language herein, as explained by and in light of the terms included herein, or the legal equivalents thereof.

The invention claimed is:

1. A bed, comprising:

a frame, said frame comprising a pair of opposing tubular stainless steel side supports and a pair of opposing tubular stainless steel end supports, said side supports and said end supports affixed each to the other by corner fixtures; a plurality of support legs affixed to said frame, said support legs adapted to support said frame above a selected substrate;

a generally horizontal support deck coupled to the frame, said support deck adapted to support a patient body, said support deck comprising a molded contaminant resistant cleanable surface, said support deck further comprising, above at least some of said support legs, a cutout portion defined by edgewalls, said cutout portion providing access through said support deck to said at least some support legs; and said generally horizontal support deck having a perimeter, and further comprising a plurality of peripheral clamping members located about said perimeter, said peripheral clamping members integrally formed with and molded as a unitary component of said support deck, and wherein said peripheral clamping members support said support deck with respect to said frame.

2. The bed as set forth in claim 1, wherein said support deck is impervious to liquids.

3. The bed as set forth in claim 1, wherein said support deck is removable and replaceable.

4. The bed as set forth in claim 1, or in claim 2, wherein said peripheral clamping members are configured for securely affixing said support deck to said side supports.

5. The bed as set forth in claim 1, or in claim 2, wherein said peripheral clamping members are configured for securely affixing said support deck to said end supports.

6. The bed as set forth in claim 4, wherein said peripheral clamping members comprise resilient, flexible portions of said support deck.

7. The bed as set forth in claim 6, wherein said peripheral clamping members are generally C-shaped in vertical cross-section.

8. The bed as set forth in claim 1, further comprising, along at least some portion of said side supports, a second cutout portion defined by second edgewalls, said second cutout portion providing access through said support deck to said side supports.

9. The bed as set forth in claim 8, further comprising at least one side rail member, said at least one side rail member detachably affixed to one of said side supports.

10. The bed as set forth in claim 8, further comprising two side rail members, said side rail members each detachably affixed to one of said side supports.

11. The bed as set forth in claim 9, or in claim 10, wherein each side rail member comprises one or more clamps to affix said side rail member to said side supports, each of said clamps further comprising a pivotally affixed locking clamp portion.

12. The bed as set forth in claim 11, wherein said clamps comprise interference fit, over centered C-shaped body members adapted to snap fit to said side supports.

13. The bed as set forth in claim 11, wherein said locking clamp portions provide a gap closing function adapted to close a gap in said clamps to provide a generally cylindrical clamp surface for compression fit to said side supports.

14. The bed as set forth in claim 8, further comprising an upwardly supported backrest portion, said upwardly supported backrest portion having a lower end pivotally affixed to said side supports.

15. The bed as set forth in claim 14, wherein backrest clamps are provided to pivotally affix said backrest to said side supports.

16. The bed as set forth in claim 14, further comprising a backrest support member, said backrest support member extending from one of said end supports to said backrest portion.

17. The bed as set forth in claim 16, wherein said backrest support member comprises an elongate member having a plurality of notches to provide support ledges, and wherein said support ledges provide support for said backrest at a selected upward angle from said support deck.

18. The bed as set forth in claim 17, wherein said support ledges are formed by generally question mark shaped walls formed by cut-outs in said elongate member.

19. The bed as set forth in claim 16, wherein said backrest support member comprises upper sidewalls forming an over-centered, snap fit cutout sized and shaped for complementary, snug fitting mating engagement with said backrest end support.

20. The bed as set forth in claim 1, wherein said support legs further comprise a removable top support cap.

21. The bed as set forth in claim 1, further comprising a plurality of support inserts, said support inserts each comprising an insert plug portion, an interference support portion, and an upper guide portion.

22. The bed as set forth in claim 21, wherein said interference support portion comprises a peripheral flange portion, said peripheral flange portion having a lower edge portion sized and shaped to support said support insert above a support leg.

23. The bed as set forth in claim 20, wherein said frame is pivotally connected to said support leg by a pivot pin, and wherein said insert plug portion comprises a cutout defining downwardly extending prongs fitting downward on either side of said pivot pin.

24. The bed as set forth in claim 22, wherein said peripheral flange portion of each support insert comprises an upper edge portion adapted to support a support leg.

25. The bed as set forth in claim 1, wherein said support leg further comprises an adjustable leg member, said adjustable leg member securely affixable at a selected length, so that said support deck is positionable at a selected height above a selected substrate.

26. The bed as set forth in claim 25, wherein said support legs each have a lower end portion, and further comprising a rolling wheel member affixed to said lower end portion.

27. The bed as set forth in claim 20, further comprising a shelving member, said shelving member having shelves spaced apart between vertical posts, said vertical posts having lower post ends, said lower post ends each sized and shaped for complementary mating engagement downward into a support insert.

28. The bed as set forth in claim 27, wherein said support inserts are located along a first side of said support deck.

29. The bed as set forth in claim 27, wherein said shelving members have a stowed configuration wherein said shelving members are configured as a generally flat shelving unit of selected thickness T.

30. The bed as set forth in claim 29, wherein said shelving members are vertically oriented when affixed to said bed in said stowed configuration.

31. The bed as set forth in claim 27, wherein said shelving members comprise adjustable shelf brackets, said adjustable shelf brackets adjustable between (a) a support position wherein said shelves are supported in a generally horizontal configuration for use, and (b) a stowed configuration, wherein said shelves are folded into a generally flat, stowed position.

32. The bed as set forth in claim 31, wherein said adjustable shelf brackets comprise an eccentric detent sized and shaped for locking support of said shelves in said support position.

33. The bed as set forth in claim 1, further comprising an autopsy tray, said autopsy tray comprising a liquid containing vessel having a generally planar surface and raised peripheral edges.

34. The bed as set forth in claim 1, wherein said stainless steel comprises surgical grade steel.

35. The bed as set forth in claim 1, wherein said stainless steel comprises 304 grade stainless steel.

36. The bed as set forth in claim 1, wherein said support deck comprises a moldable thermoplastic material.

37. The bed as set forth in claim 36, wherein said moldable thermoplastic material comprises nylon.

* * * * *

UNITED STATES PATENT AND TRADEMARK OFFICE

CERTIFICATE OF CORRECTION

PATENT NO. : 8,132,277 B2
APPLICATION NO. : 12/426199
DATED : March 13, 2012
INVENTOR(S) : John Buchanan It is certified that error appears in the above-identified patent and that said Letters Patent is hereby corrected as shown below:

IN THE SPECIFICATION:

Column 1, line 27, delete "patent" and substitute therefore --patient--.

Column 2, line 10, after the words "may be mounted in", insert --one--.

Column 2, line 44, after the words "one side of the bed," delete "so" and substitute therefore --to--.

Column 4, line 8, after the words "for a corner", delete "fixtures" and substitute therefore --fixture--.

Column 6, line 7, delete "36 and 36," and substitute therefore --34 and 36,--.

Column 6, line 31, after the words "FIGS. 7 and 8,", delete "claim".

Column 6, line 40, after the word "the", delete "claim" and substitute therefore --clamp--.

Column 6, line 58, after the word "provided", delete "when".

Column 7, line 28, after the words "provided with", delete "a" and substitute therefore --an--.

Column 7, line 58, after the words "bed 30'", insert --.--.

Column 8, line 38, after the words "angular support", delete "member" and substitute therefore --members--.

Signed and Sealed this
Third Day of July, 2012

David J. Kappos

David J. Kappos
*Director of the United States Patent and Trademark Office*